US008133330B2

(12) United States Patent
Futamura et al.

(10) Patent No.: US 8,133,330 B2
(45) Date of Patent: Mar. 13, 2012

(54) HIGH YIELD RATIO AND HIGH-STRENGTH HOT-DIP GALVANIZED STEEL SHEET EXCELLENT IN WORKABILITY AND PRODUCTION METHOD THEREOF

(75) Inventors: Yuichi Futamura, Kakogawa (JP); Masaaki Miura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/571,753

(22) Filed: Oct. 1, 2009

(65) Prior Publication Data

US 2010/0108200 A1 May 6, 2010

(30) Foreign Application Priority Data

Oct. 30, 2008 (JP) ..... 2008-280028

(51) Int. Cl.
*C21D 11/00* (2006.01)
*C22C 38/00* (2006.01)

(52) U.S. Cl. ..... 148/320; 148/337; 148/503
(58) Field of Classification Search ..... 148/503, 148/320, 337
See application file for complete search history.

(56) References Cited

U.S. PATENT DOCUMENTS

| | | | |
|---|---|---|---|
| 6,666,932 | B2 | 12/2003 | Funakawa et al. |
| 2007/0029015 | A1 | 2/2007 | Yoshinaga et al. |
| 2010/0003541 | A1 | 1/2010 | Futamura et al. |

FOREIGN PATENT DOCUMENTS

| | | | |
|---|---|---|---|
| EP | 1 978 113 | A1 | 10/2008 |
| EP | 2 000 554 | A1 | 12/2008 |
| EP | 2 138 599 | A1 | 12/2009 |
| JP | 55-122820 | | 9/1980 |
| JP | 05-179345 | | 7/1993 |
| JP | 5-179345 | | 7/1993 |

(Continued)

OTHER PUBLICATIONS

U.S. Appl. No. 12/983,482, filed Jan. 3, 2011, Futamura.

(Continued)

*Primary Examiner* — Emily Le
*Assistant Examiner* — Rebecca Lee
(74) *Attorney, Agent, or Firm* — Oblon, Spivak, McClelland, Maier & Neustadt, L.L.P.

(57) ABSTRACT

A high-strength hot-dip galvanized steel sheet excellent in workability according to the present invention: contains C, Si, Mn and other elements; has a dual phase structure containing ferrite and martensite as the metallographic structure; and, in the ferrite structure, satisfies the expression $0.2 \leqq (L_b/L_a) \leqq 1.5$ when the length per unit area of the grain boundaries of crystal grains the crystal orientation differences of which are 10 degrees or more is defined as $L_a$ and the length per unit area of the grain boundaries of crystal grains the crystal orientation differences of which are less than 10 degrees is defined as $L_b$, and further satisfies the requirements that the average value of D is 25 μm or less and the area ratio of crystal grains satisfying the expression $D \leqq 30$ μm in the ferrite grains surrounded by the grain boundaries of crystal grains the crystal orientation differences of which are 10 degrees or more is 50% or more when the circle equivalent diameter of each of ferrite grains surrounded by the grain boundaries of crystal grains the crystal orientation differences of which are 10 degrees or more is defined as D; and has a tensile strength of 980 MPa or more.

20 Claims, 2 Drawing Sheets

FOREIGN PATENT DOCUMENTS

| | | | |
|---|---|---|---|
| JP | 2001-220641 | | 8/2001 |
| JP | 2002-322539 | | 11/2002 |
| JP | 2006-274378 | | 10/2006 |
| JP | 2007-92127 | | 4/2007 |
| KR | 2006-0096002 | | 9/2006 |
| WO | WO 2007/051080 | A2 | 5/2007 |
| WO | WO 2007/051080 | A3 | 5/2007 |
| WO | WO 2007066600 | A1 * | 6/2007 |
| WO | WO 2007/111164 | A1 | 10/2007 |

OTHER PUBLICATIONS

Office Action issued Jul. 19, 2011, in Korean Patent Application No. 2009-0103541 filed Oct. 29, 2009 (with English translation).

* cited by examiner

HIGH YIELD RATIO AND HIGH-STRENGTH HOT-DIP GALVANIZED STEEL SHEET EXCELLENT IN WORKABILITY AND PRODUCTION METHOD THEREOF

FIELD OF THE INVENTION

The present invention relates to: a high-strength hot-dip galvanized steel sheet (including a high-strength alloyed hot-dip galvanized steel sheet, same as above hereunder) of 980 MPa or higher that shows a high yield ratio, has a high elongation, and is suitable for an automobile steel sheet; and a production method that is useful for producing such a high-strength hot-dip galvanized steel sheet.

BACKGROUND OF THE INVENTION

In recent years, from growing awareness of the global environmental problem, automakers are promoting the weight reduction of a car body with the aim of improving fuel consumption. In addition, from the viewpoint of the safety of a passenger, the collision safety standard of an automobile is tightened and the durability of a member against impact is also required. Consequently, the percentage of a high-strength steel sheet used in an automobile further increases recently and a high-strength hot-dip galvanized steel sheet is proactively applied for body frame members and reinforce members requiring rust preventive performance. Required properties become more advanced in accordance with the expansion of the application of the high-strength steel sheet and the improvement of the workability of a base material is strongly demanded in the case of a less-formable member.

A material developed as having both strength and workability is a dual phase steel sheet (hereunder referred to as DP steel sheet occasionally) mainly composed of ferrite and martensite. In JP-A Nos. 122820/S55 and 220641/2001 for example, a high-strength galvanized steel sheet excellent in balance between strength and elongation and the production method thereof are disclosed. In the meantime, together with the workability, energy absorbability at collision is required and a high yield strength, namely a high yield ratio, is also important in the case of a high-strength steel sheet for a body frame. In JP-A No. 322539/2002 for example, a steel sheet that makes use of precipitation particles, thus has a high yield strength, and is excellent in workability is disclosed.

In the technologies disclosed in JP-A Nos. 122820/S55 and 220641/2001 however, martensite is generated at the cooling process after galvanizing or after succeeding alloying treatment, mobile dislocations are introduced in ferrite during the cooling process, and consequently the yield strength lowers. Further, in the case of JP-A No. 322539/2002 where the yield strength is enhanced, precipitation particles of a nano level are used, but it is difficult to disperse the precipitation particles finely when annealing is applied after hot rolling or cold rolling, and thus it is also difficult to obtain both a high yield strength and a high ductility simultaneously.

In addition, a high-strength hot-dip galvanized steel sheet having both good spot weldability and a high yield ratio and the production method thereof are disclosed in JP-A No. 274378/2006. The hot-dip galvanized steel sheet however contains elongated crystal grains having an aspect ratio of three or more in the metallographic structure and thus is nonuniform structurally, and hence good workability is hardly obtainable.

SUMMARY OF THE INVENTION

The present invention has been established in view of the above circumstances and an object thereof is to provide a high-strength hot-dip galvanized steel sheet of 980 MPa or higher in tensile strength that shows a high yield ratio and has an excellent elongation.

A hot-dip galvanized steel sheet according to the present invention that has solved the above problems is a hot-dip galvanized steel sheet containing C: 0.05 to 0.3% (in terms of mass %, hereunder same as above with respect to chemical composition), Si: 0.005 to 3.0%, Mn: 1.5 to 3.5%, Al: 0.005 to 0.15%, P: 0.1% or less, and S: 0.05% or less, with the remainder consisting of iron and unavoidable impurities, wherein: in percentage in a metallographic structure, the area ratio of ferrite is 5 to 85%, the area ratio of martensite is 15 to 90%, the area ratio of retained austenite is 20% or less, and the sum of the area ratios of the ferrite, the martensite, and the retained austenite is 70% or more; in the ferrite structure, when the length per unit area of the grain boundaries of crystal grains the crystal orientation differences of which are 10 degrees or more is defined as $L_a$ and the length per unit area of the grain boundaries of crystal grains the crystal orientation differences of which are less than 10 degrees is defined as $L_b$, the expression $0.2 \leqq (L_b/L_a)$ 1.5 is satisfied; when the circle equivalent diameter of each of ferrite grains surrounded by the grain boundaries of crystal grains the crystal orientation differences of which are 10 degrees or more is defined as D, the average value of D is 25 μm or less, and the area ratio of crystal grains satisfying the expression $D \leqq 30$ μm in the ferrite grains surrounded by the grain boundaries of crystal grains the crystal orientation differences of which are 10 degrees or more is 50% or more; and the tensile strength of the hot-dip galvanized steel sheet is 980 MPa or more.

A high-strength hot-dip galvanized steel sheet according to the present invention, if necessary, may further contain (a) Cr: 1.0% or less, (b) Mo: 1.0% or less, (c) at least one selected from among the group of Ti: 0.2% or less, Nb: 0.3% or less, and V: 0.2% or less, (d) Cu: 3% or less and/or Ni: 3% or less, (e) B: 0.01% or less, and (f) at least one selected from among the group of Ca: 0.01% or less, Mg: 0.01% or less, and REM: 0.005% or less.

Hot-dip galvanizing applied in the present invention may be alloying hot-dip galvanizing.

Further, the present invention includes a method for producing a hot-dip galvanized steel sheet according to the present invention and the production method includes the steps of: heating a cold-rolled steel sheet satisfying the aforementioned chemical composition so that the heating rate may satisfy the expressions (1) to (3) below and the highest achieved temperature during the heating may satisfy the expression (4); and applying annealing so that the residence time in the temperature range from 600° C. to the highest achieved temperature may be 400 seconds or less, $$\text{heating rate from room temperature to 350° C.: } HR1 \leqq 900° \text{ C./min.} \quad (1),$$

$$\text{heating rate from 350° C. to 700° C.: } HR2 \geqq 60° \text{ C./min.} \quad (2),$$

$$5° \text{ C./min.} \leqq \text{heating rate from 700° C. to highest achieved temperature: } HR3 \leqq 420° \text{ C./min.} \quad (3),$$

$$Ac_1 \text{ point} \leqq (\text{highest achieved temperature}) \leqq (\text{lower temperature of either } T_{rec} \text{ or } Ac_3 \text{ point}) \quad (4),$$

where $T_{rec}$ is defined as $$T_{rec} = -4 \times (\text{cold reduction ratio}) + 1{,}000 + 3 \times (Si\ \%) + 14 \times (Mn\ \%) + 2 \times (Cr\ \%) + 19 \times (Mo\ \%) + 38 \times (Cu\ \%) + 2 \times (Ni\ \%),$$

when none of Ti, Nb, and V is contained, and $$T_{rec}=-10\times(\text{cold reduction ratio})+1{,}100+3\times(\text{Si }\%)+14\times(\text{Mn }\%)+2\times(\text{Cr }\%)+19\times(\text{Mo }\%)+38\times(\text{Cu }\%)+2\times(\text{Ni }\%)+5{,}000\times(\text{Ti }\%)+6{,}200\times(\text{Nb }\%)+4{,}350\times(\text{V }\%),$$

when at least one of Ti, Nb, and V is contained.
(each (element name %) represents the content (mass %) of each element).

A high-strength hot-dip galvanized steel sheet according to the present invention makes it possible to provide a hot-dip galvanized steel sheet of 980 MPa or more having a high yield ratio and being excellent in elongation since, in the present invention, the ratio ($L_b/L_a$) of the length $L_b$ per unit area of the grain boundaries of crystal grains the crystal orientation differences of which are less than 10 degrees to the length $L_a$ per unit area of the grain boundaries of crystal grains the crystal orientation differences of which are 10 degrees or more is controlled to a prescribed range and the grain diameters and the grain size distribution of the ferrite grains surrounded by the grain boundaries of crystal grains the crystal orientation differences of which are 10 degrees or more are controlled appropriately.

DETAILED DESCRIPTION OF THE PREFERRED EMBODIMENTS

Figure 1:
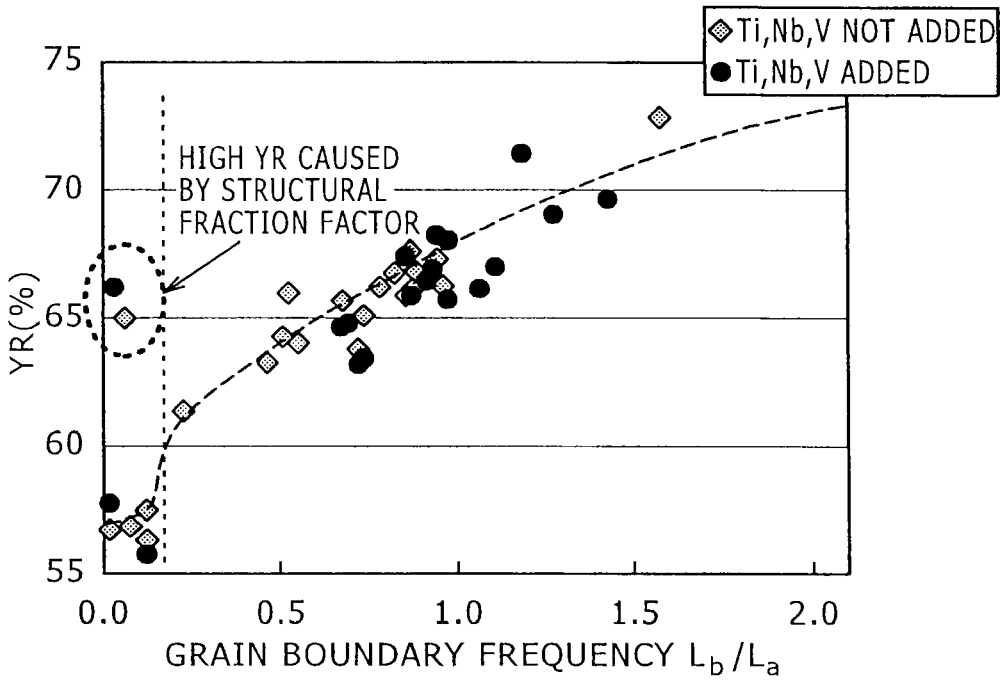
FIG. 1 is a graph showing the relationship between a grain boundary frequency ($L_b/L_a$) and a yield ratio (YR)

The present inventors have earnestly studied for realizing a high-strength hot-dip galvanized steel sheet of 980 MPa or more having a high yield ratio and being excellent in elongation in a dual phase steel sheet containing ferrite and martensite in the metallographic structure. As a result, the present inventors: have found that, in addition to the control of the chemical composition of a steel, (i) it is possible to improve a yield ratio by controlling the ratio ($L_b/L_a$) (hereunder referred to as "grain boundary frequency" occasionally) of the length $L_b$ per unit area of the grain boundaries of crystal grains the crystal orientation differences of which are less than 10 degrees to the length $L_a$ per unit area of the grain boundaries of crystal grains the crystal orientation differences of which are 10 degrees or more to a prescribed range and (ii) it is possible to improve elongation by homogenizing the grain size distribution (hereunder referred to as "grain size frequency" occasionally) of crystal grains so that, when circle equivalent diameter of each of ferrite grains surrounded by the grain boundaries of crystal grains the crystal orientation differences of which are 10 degrees or more is defined as D, the average value of D may be 25 μm or less, and the area ratio of crystal grains satisfying the expression $D \leqq 30$ μm in the ferrite grains surrounded by the grain boundaries of crystal grains the crystal orientation differences of which are 10 degrees or more may be 50% or more; and have completed the present invention.

Firstly, the chemical composition of a high-strength hot-dip galvanized steel sheet according to the present invention is explained hereunder.

C: 0.05 to 0.3%

C is an element important for securing the strength of a steel sheet. Further, C has the function of influencing the quantity and the shape of a generated martensite structure and improving the elongation. Consequently, a C amount is set at 0.05% or more. A C amount is preferably 0.06% or more and yet preferably 0.07% or more. On the other hand, if a C amount is excessive, weldability deteriorates. Consequently, a C amount is set at 0.3% or less. AC amount is preferably 0.25% or less and yet preferably 0.2% or less.

Si: 0.005 to 3.0%

Si is an element contributing to the improvement of the strength of a steel sheet by solid solution strengthening without the deterioration of elongation. In order to exhibit the effect, a Si amount is preferably 0.005% or more and yet preferably 0.01% or more. On the other hand, if a Si amount is excessive, the strength increases excessively, rolling load increases, scale is formed during hot rolling, and thus the surface appearance of the steel sheet deteriorates. Consequently, a Si amount is set at 3.0% or less. A Si amount is preferably 2.5% or less and yet preferably 2.0% or less.

Mn: 1.5 to 3.5%

Mn is an element important for securing the strength of a steel sheet. Consequently, a Mn amount is set at 1.5% or more. A Mn amount is preferably 1.7% or more and yet preferably 2.0% or more. On the other hand, if a Mn amount is excessive, elongation deteriorates and hence a Mn amount is set at 3.5% or less. A Mn amount is preferably 3.2% or less and yet preferably 3.0% or less.

Al: 0.005 to 0.15%

Al is an element that has a deoxidation function. Consequently, an Al amount is set at 0.005% or more. An Al amount is preferably 0.01% or more and yet preferably 0.03% or more. On the other hand, if an Al amount is excessive, the cost increases and hence an Al amount is set at 0.15% or less. An Al amount is preferably 0.1% or less and yet preferably 0.07% or less.

P: 0.1% or less

P deteriorates weldability if it is excessive. Consequently, a P amount is set at 0.1% or less. A P amount is preferably 0.08% or less and yet preferably 0.05% or less.

S: 0.05% or less.

S, if it is excessive, increases sulfide type inclusions and deteriorates the strength of a steel sheet. Consequently, a S amount is set at 0.05% or less. A S amount is preferably 0.01% or less and yet preferably 0.007% or less.

Fundamental components in a steel used in the present invention are as stated above and the remainder substantially consists of iron. Here, unavoidable impurities that are brought in accordance with the situations of raw materials, materials, production equipment, and others are permissibly included in a steel as a matter of course. As the unavoidable impurities for example, N, O, and tramp elements (Sn, Zn, Pb, As, Sb, Bi, and others) are named. N is an element that precipitates as nitride and improves the strength of a steel. If N exists excessively however, nitride also increases excessively and elongation deteriorates. Consequently, a N amount is preferably 0.01% or less. Meanwhile, if an O amount is excessive, elongation deteriorates and hence an O amount is preferably 0.01% or less.

Further, a steel used in the present invention may contain the following arbitrary elements if needed.

Cr: 1.0% or less

Cr is an element that is effective in enhancing the hardenability of a steel and increasing the strength. In particular, Cr: has a remarkable effect in suppressing the formation of a bainite structure that is an intermediate transformation structure in comparison with Mo that will be stated later; and is an element effective in obtaining a dual phased steel sheet mainly composed of ferrite and martensite. In order to exhibit the effects, a Cr amount is preferably 0.04% or more and yet preferably 0.07% or more. On the other hand, if a Cr amount is excessive, ductility deteriorates. Consequently, a preferable Cr amount is 1.0% or less. A Cr amount is yet preferably 0.8% or less and still yet preferably 0.6% or less.

Mo: 1.0% or less

Mo is an element that is effective in enhancing the hardenability of a steel and increasing the strength. In order to exhibit the effect, a Mo amount is preferably 0.04% or more and yet preferably 0.07% or more. On the other hand, if a Mo amount is excessive, ductility deteriorates and also the cost increases. Consequently, a preferable Mo amount is 1.0% or less. A Mo amount is yet preferably 0.8% or less and still yet preferably 0.6% or less.

At least one selected from among the group of Ti: 0.2% or less, Nb: 0.3% or less, and V: 0.2% or less Any of Ti, Nb, and V has the functions of: improving the strength of a steel by forming precipitates of carbide and nitride; and suppressing recrystallization. That is, it is possible to maintain a processed structure, increase the grain boundary frequency ($L_b/L_a$), and obtain a high yield strength. A Ti amount is preferably 0.01% or more and yet preferably 0.02% or more. A Nb amount is preferably 0.01% or more and yet preferably 0.03% or more. Further, a V amount is preferably 0.01% or more and yet preferably 0.03% or more. On the other hand, if the elements are excessive and the grain boundary frequency ($L_b/L_a$) increases excessively, elongation deteriorates. Consequently, it is preferable to control a Ti amount to 0.2% or less, a Nb amount to 0.3% or less, and a V amount to 0.2% or less. A Ti amount is yet preferably 0.15% or less and still yet preferably 0.1% or less. A Nb amount is yet preferably 0.2% or less and still yet preferably 0.15% or less. A V amount is yet preferably 0.15% or less and still yet preferably 0.13% or less.

Cu: 3% or less and/or Ni: 3% or less

Cu and Ni are elements that are effective in increasing the strength of a steel sheet. In order to exhibit the effect, a Cu amount is preferably 0.05% or more and yet preferably 0.1% or more. Also a Ni amount is preferably 0.05% or more and yet preferably 0.1% or more. On the other hand, if Cu and Ni are excessive, hot workability deteriorates. Consequently, a Cu amount is preferably 3% or less and also a Ni amount is preferably 3% or less. A Cu amount is yet preferably 2% or less and still yet preferably 1% or less, and also a Ni amount is yet preferably 2% or less and still yet preferably 1% or less.

B: 0.01% or less

B, like Cr and Mo, is an element effective in enhancing the hardenability of a steel and increasing the strength. In order to exhibit the effects, a B amount is preferably 0.001% or more and yet preferably 0.0015% or more. On the other hand, if a B amount is excessive, boride is generated conspicuously and ductility deteriorates. Consequently, a B amount is preferably 0.01% or less. A B amount is yet preferably 0.008% or less and still yet preferably 0.005% or less.

At least one selected from among the group of Ca: 0.01% or less, Mg: 0.01% or less, and REM: 0.005% or less Ca, Mg, and REM are elements contributing to the shape control of inclusions, in particular to finely dispersing inclusions. In order to exhibit the effect, a Ca amount is preferably 0.0005% or more and yet preferably 0.001% or more. Also, a Mg amount is preferably 0.0005% or more and yet preferably 0.001% or more, and a REM amount is preferably 0.0005% or more and yet preferably 0.001% or more. On the other hand, if those elements are excessive, forgeability and hot working deteriorate and ductility also deteriorates. Consequently, it is preferable to control a Ca amount to 0.01% or less, a Mg amount to 0.01% or less, and a REM amount to 0.005% or less. A Ca amount is yet preferably 0.007% or less and still yet preferably 0.005% or less. A Mg amount is yet preferably 0.007% or less and still yet preferably 0.005% or less. Then a REM amount is yet preferably 0.003% or less and still yet preferably 0.002% or less.

The first feature of the metallographic structure of a high-strength hot-dip galvanized steel sheet according to the present invention lies in that, in a dual phase steel sheet containing ferrite and martensite, a yield strength, namely a yield ratio, is improved by controlling the ratio ($L_b/L_a$) of the length $L_b$ per unit area of the grain boundaries of crystal grains the crystal orientation differences of which are less than 10 degrees to the length $L_a$ per unit area of the grain boundaries of crystal grains the crystal orientation differences of which are 10 degrees or more to the range represented by the expression $0.2 \leqq (L_b/L_a) \leqq 1.5$ and thereby securing the grain boundaries of crystal grains the crystal orientation differences of which are less than 10 degrees by a prescribed percentage or more. Further, the second feature thereof lies in that elongation is improved by, when the circle equivalent diameter of each of ferrite grains surrounded by the grain boundaries of crystal grains the crystal orientation differences of which are 10 degrees or more is defined as D, reducing the average value of D to 25 μm or less and homogenizing the grain size distribution of crystal grains so that the area ratio of crystal grains satisfying the expression $D \leqq 30$ μm in the ferrite grains surrounded by the grain boundaries of crystal grains the crystal orientation differences of which are 10 degrees or more may be 50% or more. The features are hereunder explained one by one.

The reason why the crystal orientation difference is classified with the boundary of 10 degrees in the present invention is that the influence of the grain boundaries of crystal grains the crystal orientation differences of which are 10 degrees or less on mechanical properties (yield ratio, tensile strength, and elongation) is different from the influence of the grain boundaries of crystal grains the crystal orientation differences of which are 10 degrees or more on the mechanical properties.

Firstly, the grain boundaries of crystal grains the crystal orientation differences of which are less than 10 degrees are formed by introducing a processed structure at a cold-rolling process before annealing and generating sub-grains by the recovery of a dislocation structure at the succeeding annealing process. The grain boundaries of crystal grains the crystal orientation differences of which are less than 10 degrees can suppress the movement of mobile dislocations in ferrite that causes a yield strength to deteriorate and thus a yield strength can be improved and a high yield ratio can be obtained. In order to fully exhibit the effect, the ratio ($L_b/L_a$) of the length $L_b$ per unit area of the grain boundaries of crystal grains the crystal orientation differences of which are less than 10 degrees to the length $L_a$ per unit area of the grain boundaries of crystal grains the crystal orientation differences of which are 10 degrees or more is set at 0.2 or more. The significance of the present invention lies in that: the ratio of the length ($L_b$) per unit area of the grain boundaries of crystal grains the crystal orientation differences of which are less than 10 degrees to the length ($L_a$) per unit area of the grain boundaries of crystal grains the crystal orientation differences of which are 10 degrees or more represents the proportion of the grain boundaries that can suppress the movement of mobile dislocations in a ferrite grain; and correlation between the suppression effect of mobile dislocation and a yield ratio is found out. Here, in the present invention, the yield strength is increased by stopping the movement of dislocations in an elastic region and hence the behavior of work hardening in a succeeding plastic region is not much influenced. As a result, it is possible to increase a yield strength while the excellent tensile strength and elongation of a dual phase steel sheet are maintained. The ratio ($L_L/L_a$) is preferably 0.25 or more and yet preferably 0.30 or more. On the other hand, if the ratio ($L_b/L_a$) is excessively large, namely if a processed structure remains excessively, the elongation deteriorates. Consequently, the ratio ($L_b/L_a$) is set at 1.5 or less. The ratio ($L_b/L_a$) is preferably 1.4 or less, and yet preferably 1.3 or less.

Secondary, the crystal grains surrounded by the grain boundaries of crystal grains the crystal orientation differences of which are 10 degrees or more largely influence the elongation of a steel sheet. That is, when the crystal grains surrounded by the grain boundaries of crystal grains the crystal orientation differences of which are 10 degrees or more coarsen, stress concentration occurs remarkably at local distortion and total elongation lowers due to the deterioration of local elongation. Consequently, when circle equivalent diameter of each of ferrite grains surrounded by the grain boundaries of crystal grains the crystal orientation differences of which are 10 degrees or more is defined as D, the average value of D is set at 25 μm or less. The average value of D is preferably 20 μm or less, and yet preferably 15 μm or less. The lower limit of the average value of D is not particularly limited but may be about 0.5 μm for example.

Further, with regard to the grain size distribution of ferrite grains surrounded by the grain boundaries of crystal grains the crystal orientation differences of which are 10 degrees or more, if the grain size distribution is nonuniform, elongation (EL) deteriorates. Consequently, the area ratio of crystal grains satisfying the expression $D \leqq 30$ μm in the ferrite grains surrounded by the grain boundaries of crystal grains the crystal orientation differences of which are 10 degrees or more is set at 50% or more, preferably 60% or more, and yet preferably 70% or more.

A length per unit area of the grain boundaries of crystal grains the crystal orientation differences of which are 10 degrees or more and a length per unit area of the grain boundaries of crystal grains the crystal orientation differences of which are less than 10 degrees can be obtained by carrying out crystallographic analysis by the SEM (Scanning Electron Microscope)-EBSP (Electron BackScattering Pattern) method. In the EBSP method, it is possible to recognize a grain boundary frequency ($L_b/L_a$) and ferrite grains by measuring not less than three visual fields in the area of at least 50 μm×50 μm at the steps of 1 μm less and carrying out crystal orientation analysis under the condition of CI value $\geqq 0.1$. Further, the average grain diameter of ferrite grains surrounded by the grain boundaries of crystal grains the crystal orientation differences of which are 10 degrees or more can be obtained by an ordinary method, such as a cutting method, a quadrature method, or a comparison method. With regard to the grain size distribution, the proportion of the area of the ferrite grains 30 μm or less in grain diameter in the area of the ferrite grains surrounded by the grain boundaries of crystal grains the crystal orientation differences of which are 10 degrees or more is obtained.

A high-strength hot-dip galvanized steel sheet according to the present invention is a dual phase steel sheet containing ferrite and martensite and the sum of the areas of the ferrite and the martensite is preferably 65% or more in area percentage in the metallographic structure. The ferrite means polygonal ferrite in the present invention. Further, the martensite means quenched martensite in the present invention and that means that the martensite includes martensite self-tempered during cooling but tempered martensite tempered at 200° C. or higher is not included.

A high-strength hot-dip galvanized steel sheet according to the present invention may be composed of only ferrite and martensite but may contain retained austenite with the aim of improving ductility. Ferrite has the effect of improving ductility but, if ferrite is excessive in contrast, strength lowers. Martensite has the effect of improving strength but, if martensite is excessive in contrast, ductility lowers. Then retained austenite has the effect of improving ductility but, if retained austenite is excessive in contrast, elongation and flange forming capability deteriorate, also the carbon concentration in the retained austenite reduces, and thereby the elongation deteriorates. Consequently, it is preferable to appropriately adjust the fractions of ferrite, martensite, and retained austenite in the ranges of 5 to 85% in the area ratio of ferrite, 15 to 90% in the area ratio of martensite, and 20% or less in the area ratio of retained austenite in accordance with required balance between strength and ductility, and further, from the viewpoint of improving ductility, it is preferable to control the sum of the area ratios of the ferrite, the martensite, and the retained austenite to 70% or more. A yet preferable sum of the area ratios of the ferrite, the martensite, and the retained austenite is 75% or more.

In the present invention further, besides ferrite, martensite, and retained austenite, bainite and pearlite may be contained within the range not hindering the effects of the present invention. The sum of the contents of bainite and pearlite is preferably 30% or less in area percentage.

In the metallographic structure of a steel sheet, it is possible to identify ferrite and martensite by observing a portion in the depth of t/4 (t: sheet thickness) on a cross section perpendicular to the rolling direction of the steel sheet at the magnification of 3,000 with a scanning electron microscope (SEM). Retained austenite can be obtained by measuring a volume fraction by a saturation magnetization method (R & D Kobe Steel Engineering Reports, Vol. 52 No. 3) and converting the volume fraction into an area ratio.

For producing a high-strength hot-dip galvanized steel sheet according to the present invention, it is effective to control a heating rate, a highest achieved temperature, and a residence time in a prescribed temperature range particularly at an annealing process after cold rolling. More specifically, a steel sheet according to the present invention can be produced by: heating a cold-rolled steel sheet having an above chemical composition so that the heating rate may satisfy the expressions (1) to (3) below and the highest achieved temperature during the heating may satisfy the expression (4) below; and applying annealing so that the residence time in the temperature range from 600° C. to the highest achieved temperature may be 400 seconds or less. The production conditions are hereunder explained in detail.

Firstly, the heating temperature range is divided into three temperature regions, namely from room temperature to 350° C., from 350° C. to 700° C., and from 700° C. to the highest achieved temperature, and heating is applied so that the heating rate may satisfy the expressions (1) to (3) below and the highest achieved temperature may satisfy the expression (4) below.

Heating rate from room temperature to 350° C.:

$$HR1 \leqq 900° \text{ C./min.} \quad (1)$$

At the heating in the range from room temperature to 350° C., it is possible to release residual stress in a processed ferrite structure and secure good elongation (EL) through the recovery behavior of a structure that will be described later. That is, if HR1 exceeds 900° C./min., a processed structure recovers remarkably during the heating in the temperature range from 350° C. to 700° C. that is described below, the proportion of the grain boundaries of crystal grains the crystal orientation differences of which are less than 10 degrees reduces, and the yield strength lowers. Consequently, the upper limit of HR1 is set at 900° C./min. HR1 is preferably 750° C./min. or lower and yet preferably 600° C./min. or lower. The lower limit of HR1 is not particularly limited but may be about 1° C./min. for example.

$$\text{Heating rate from 350° C. to 700° C.: HR2} \geqq 60° \text{ C./min.} \quad (2)$$

A heating rate from 350° C. to 700° C. largely influences the recovery behavior of a processed structure. If HR2 is less than 60° C./min., the processed structure recovers remarkably, the proportion of the grain boundaries of crystal grains the crystal orientation differences of which are less than 10 degrees reduces, and the yield strength lowers. Consequently, HR2 is set at 60° C./min. or higher. HR2 is preferably 90° C./min. or higher and yet preferably 120° C./min. or higher. On the other hand, if HR2 is too high and the processed structure hardly recovers, recrystallization advances in the temperature range from 700° C. to the highest achieved temperature, hence the structure after annealing may not resultantly include the grain boundaries of crystal grains the crystal orientation differences of which are less than 10 degrees, and on that occasion the yield strength lowers. Consequently, HR2 is preferably 1,500° C./min. or lower.

$$5° \text{ C./min.} \leqq \text{heating rate from 700° C. to a highest achieved temperature: HR3} \leqq 420° \text{ C./min.} \quad (3)$$

The temperature range from 700° C. to a highest achieved temperature is a temperature range where austenite is reversely transformed from a processed structure and the heating rate in the temperature range is important for securing the structure fraction and realizing a good elongation (EL). If HR3 is lower than 5° C./min., either the structure recovers remarkably by the progress of reverse transformation or recrystallization occurs, and the proportion of the grain boundaries of crystal grains the crystal orientation differences of which are less than 10 degrees reduces. Consequently, HR3 is set at 5° C./min. or higher. HR3 is preferably 7° C./min. or higher and yet preferably 10° C./min. or higher. On the other hand, if HR3 exceeds 420° C./min., recovery scarcely occurs, the grain boundaries of crystal grains the crystal orientation differences of which are less than 10 degrees remain abundantly, and elongation deteriorates. Consequently, HR3 is set at 420° C./min. or lower. HR3 is preferably 400° C./min. or lower and yet preferably 350° C./min. or lower.

$$Ac_1 \text{ point} \leqq (\text{highest achieved temperature}) \leqq (\text{lower temperature of either } T_{rec} \text{ or } Ac_3 \text{ point}) \quad (4)$$

An $Ac_t$ point is the lower limit of the temperature at which reverse transformation into austenite occurs. If a highest achieved temperature is lower than the $Ac_1$ point, reverse transformation into austenite does not occur, hence a DP structure is not obtained, and an excellent elongation cannot be secured. The lower limit of a highest achieved temperature is preferably an $Ac_1$ point+20° C. and yet preferably an $Ac_1$ point+50° C. Here, an $Ac_1$ point is computed with the following expression. In the following expression, each (element name %) represents the content (mass %) of each element (hereunder same as above).

$$Ac_1 = 723 + 29.1 \times (\text{Si \%}) - 10.7 \times (\text{Mn \%}) + 16.9 \times (\text{Cr \%}) - 16.9 \times (\text{Ni \%})$$

The upper limit of a highest achieved temperature is set at the lower temperature of either a temperature ($T_{rec}$) at which the recrystallization of a processed structure does not occur or the lowest temperature ($Ac_3$ point) at which an austenite single phase is formed.

Firstly, if a highest achieved temperature exceeds $T_{rec}$, a processed structure recrystallizes, a desired structure is not obtained, and a high yield strength cannot be obtained although elongation is excellent or the elongation is poor although a high yield strength can be obtained.

Here, $T_{rec}$ is greatly influenced by a cold reduction ratio. That is, as a cold reduction ratio increases, strain energy is accumulated, driving force for recrystallization increases, and hence the recrystallization start temperature lowers. Further, $T_{rec}$ increases by the addition of an alloying element, in particular by the addition of Si, Mn, Cr, Mo, Cu, and Ni. In particular, $T_{rec}$ increases remarkably if Ti, Nb, and V are added. The expression below used for computing $T_{rec}$ is made up by summing the elements and the cold reduction ratio, influencing the recrystallization temperature, each of which is multiplied by each coefficient representing each contribution ratio. Here, with regard to the coefficient by which the cold reduction ratio is multiplied, in the case where at least one of Ti, Nb, and V is contained, because of the reason that $T_{rec}$ is influenced by precipitates caused by those elements or solid solution elements and hence (i) the quantity of strain introduced during cold rolling increases and (ii) susceptibility of a critical cold reduction ratio for generating recrystallization increases and other reasons, the coefficient is different from the case where none of Ti, Nb, and V is contained.

More specifically, in the case where none of Ti, Nb, and V is contained, $T_{rec}$ is computed with the following expression;

$$T_{rec} = -4 \times (\text{cold reduction ratio}) + 1{,}000 + 3 \times (\text{Si \%}) + 14 \times (\text{Mn \%}) + 2 \times (\text{Cr \%}) + 19 \times (\text{Mo \%}) + 38 \times (\text{Cu \%}) + 2 \times (\text{Ni \%}).$$

In the case where at least one of Ti, Nb, and V is contained, $T_{rec}$ is computed with the following expression;

$$T_{rec} = -10 \times (\text{cold reduction ratio}) + 1{,}100 + 3 \times (\text{Si \%}) + 14 \times (\text{Mn \%}) + 2 \times (\text{Cr \%}) + 19 \times (\text{Mo \%}) + 38 \times (\text{Cu \%}) + 2 \times (\text{Ni \%}) + 5{,}000 \times (\text{Ti \%}) + 6{,}200 \times (\text{Nb \%}) + 4{,}350 \times (\text{V \%}).$$

Secondary, if a highest achieved temperature exceeds the $Ac_3$ point, all the ferrite in which a processed structure remains transforms into austenite and hence a desired structure is not obtained. Here, the $Ac_3$ point is computed with the following expression;

$$Ac_3 = 910 - 203 \times (\text{C \%})^{1/2} + 44.7 \times (\text{Si \%}) - 30 \times (\text{Mn \%}) - 11 \times (\text{Cr \%}) + 31.5 \times (\text{Mo \%}) - 20 \times (\text{Cu \%}) - 15.2 \times (\text{Ni \%}) + 400 \times (\text{Ti \%}) + 104 \times (\text{V \%}) + 700 \times (\text{P \%}) + 400 \times (\text{Al \%}).$$

Then the highest achieved temperature is set at the lower temperature of either $T_{rec}$ or an $Ac_3$ point. An upper limit temperature is preferably the lower temperature of either $T_{rec}$−5° C. or an $Ac_3$ point−5° C., and yet preferably the lower temperature of either $T_{rec}$−10° C. or an $Ac_3$ point−10° C.

Residence Time in the Temperature Range from 600° C. to a Highest Achieved Temperature is 400 Seconds or Less.

The Residence time in the temperature range from 600° C. to a highest achieved temperature means the sum of the time required for heating from 600° C. to a highest achieved temperature and the time during which the highest achieved temperature is maintained. The residence time is important for appropriately controlling the recovery of a processed structure, recrystallization behavior, and phase transformation behavior. If the time in the temperature range exceeds 400 seconds, the processed structure recovers remarkably against the progress of reverse transformation from ferrite to austenite or recrystallization occurs, and thus the proportion of the grain boundaries of crystal grains the crystal orientation differences of which are less than 10 degrees reduces. Consequently, the residence time in the temperature range from 600° C. to a highest achieved temperature is set at 400 seconds or shorter. The residence time is preferably 350 seconds or shorter and yet preferably 300 seconds or shorter. The lower limit of the time in the temperature range is not particularly limited but may be about 30 seconds for example.

With regard to production conditions other than the aforementioned production conditions, although ordinary conditions may be adopted and there are no particular limitations, with regard to hot rolling for example, it is possible to apply hot rolling at a finishing temperature of 800° C. or higher and coiling at 700° C. or lower. After the hot rolling, pickling may be applied if necessary and cold rolling may be applied at a cold reduction ratio of about 10% to 70% for example. Meanwhile, a hot-dip galvanizing process or an alloying hot-dip galvanizing process after annealing does not influence the structure of a steel sheet according to the present invention and the conditions are not particularly limited but it is preferable for example to, after the annealing: cool the steel sheet to a galvanizing bath temperature (for example, 440° C. to 480° C.) at an average cooling rate of 1° C./sec. or higher; apply hot-dip galvanizing; and then cool it to room temperature at an average cooling rate of 3° C./sec. or higher. In the case of applying alloying, it is preferable to: heat a steel sheet to a temperature in the range roughly from 500° C. to 750° C. after the hot-dip galvanizing; thereafter apply alloying for about 20 seconds; and cool it to room temperature at an average cooling rate of 3° C./sec. or higher.

Examples

The present invention is hereunder explained more specifically in reference to examples, but the present invention is not limited by the following examples by its very nature, and it is a matter of course that the present invention may be appropriately modified within the range conforming to the aforementioned and after-mentioned gist and those modifications are included in the technological scope of the present invention.

Steels having the chemical compositions shown in Tables 1 and 2 are melted and refined with a converter by an ordinary refining method and slabs are produced by subjecting the steels to continuous casting (slab thickness: 230 mm). The slabs are heated to 1,250° C., thereafter hot-rolled at a finishing temperature of 900° C. with an accumulated reduction ratio of 99%, successively cooled at an average cooling rate of 50° C./sec., and thereafter coiled at 500° C., and thus hot-rolled steel sheets are obtained (sheet thickness: 2.5 mm). Further, the obtained hot-rolled steel sheets are pickled, and thereafter cold-rolled at the cold reduction ratios shown in Tables 3 and 4, and thus cold-rolled steel sheets are obtained. The obtained cold-rolled steel sheets are annealed and galvanized at the heating rates, the highest achieved temperatures, and the residence times shown in Tables 3 and 4 in a continuous hot-dip galvanizing line. In the tables, "GA" represents hot-dip galvanizing and steel sheets are cooled to the galvanizing bath temperature (460° C.) at an average cooling rate of 5° C./sec. after annealing and cooled to room temperature at an average cooling rate of 3° C./sec. after the galvanizing. Meanwhile, "GA" represents alloying hot-dip galvanizing and steel sheets are cooled to the galvanizing bath temperature (460° C.) at an average cooling rate of 5° C./sec. after annealing, heated to 550° C. and alloyed, and thereafter cooled to room temperature at an average cooling rate of 3° C./sec. Here, REM shown in Tables 1 and 2 is added in the form of misch metal containing La by about 50% and Ce by about 30%.

TABLE 1

| Steel | Chemical components (mass %) (remainder: iron and unavoidable impurities) | | | | | | | | | | | | | | | | | |
|---|---|---|---|---|---|---|---|---|---|---|---|---|---|---|---|---|---|---|
| grade | C | Si | Mn | P | S | Al | Cr | Mo | Cu | Ni | B | Ca | Mg | REM | N | Ti | Nb | V |
| 1 | 0.118 | 0.22 | 2.85 | 0.02 | 0.001 | 0.06 | — | — | — | — | — | — | — | — | 0.003 | — | — | — |
| 2 | 0.096 | 1.96 | 2.27 | 0.01 | 0.002 | 0.04 | 0.20 | — | — | — | — | — | — | — | 0.004 | — | — | — |
| 3 | 0.089 | 0.03 | 2.79 | 0.02 | 0.001 | 0.06 | 0.34 | 0.12 | — | — | — | — | — | — | 0.003 | — | — | — |
| 4 | 0.106 | 2.37 | 2.20 | 0.01 | 0.002 | 0.04 | — | — | — | — | 0.0018 | 0.0018 | — | 0.0015 | 0.003 | — | — | — |
| 5 | 0.245 | 0.01 | 1.57 | 0.01 | 0.001 | 0.04 | 0.16 | 0.65 | — | — | — | — | — | — | 0.004 | — | — | — |
| 6 | 0.152 | 1.12 | 1.87 | 0.01 | 0.001 | 0.05 | 0.71 | — | 0.08 | 0.05 | — | — | 0.0023 | — | 0.004 | — | — | — |
| 7 | 0.106 | 2.31 | 2.10 | 0.01 | 0.001 | 0.04 | — | 0.13 | — | — | 0.0015 | — | — | — | 0.003 | — | — | — |
| 8 | 0.144 | 0.02 | 2.35 | 0.02 | 0.002 | 0.06 | 0.22 | 0.27 | — | — | — | — | — | — | 0.004 | — | — | — |
| 9 | 0.069 | 0.73 | 2.89 | 0.01 | 0.001 | 0.06 | 0.35 | — | — | — | — | — | — | — | 0.002 | — | — | — |
| 10 | 0.082 | 0.82 | 3.25 | 0.02 | 0.001 | 0.04 | 0.28 | — | — | — | — | — | — | — | 0.003 | — | — | — |
| 11 | 0.214 | 0.54 | 2.03 | 0.01 | 0.001 | 0.06 | 0.23 | — | — | — | — | — | — | — | 0.003 | — | — | — |
| 12 | 0.097 | 1.89 | 2.50 | 0.01 | 0.002 | 0.04 | 0.36 | 0.21 | — | — | — | 0.0025 | — | — | 0.003 | — | — | — |
| 13 | 0.171 | 1.33 | 2.63 | 0.01 | 0.002 | 0.05 | — | — | — | — | — | — | — | — | 0.003 | — | — | — |
| 14 | 0.132 | 1.67 | 2.80 | 0.01 | 0.001 | 0.05 | 0.30 | — | — | — | — | — | — | — | 0.004 | — | — | — |
| 15 | 0.153 | 0.87 | 2.55 | 0.01 | 0.001 | 0.05 | — | 0.13 | 0.45 | 0.53 | — | — | — | — | 0.003 | — | — | — |

* "—" means additive-free

TABLE 2

| Steel | Chemical components (mass %) (remainder: iron and unavoidable impurities) | | | | | | | | | | | | | | | | | |
|---|---|---|---|---|---|---|---|---|---|---|---|---|---|---|---|---|---|---|
| grade | C | Si | Mn | P | S | Al | Cr | Mo | Cu | Ni | B | Ca | Mg | REM | N | Ti | Nb | V |
| 16 | 0.092 | 0.01 | 2.76 | 0.02 | 0.001 | 0.06 | 0.35 | 0.13 | — | — | — | — | — | — | 0.004 | 0.065 | — | — |
| 17 | 0.095 | 1.76 | 2.08 | 0.01 | 0.002 | 0.03 | 0.17 | — | — | — | — | — | — | — | 0.003 | 0.041 | — | — |
| 18 | 0.221 | 0.25 | 2.13 | 0.02 | 0.001 | 0.06 | — | — | — | — | 0.0021 | — | 0.0019 | — | 0.005 | — | 0.061 | — |
| 19 | 0.121 | 0.15 | 2.58 | 0.01 | 0.002 | 0.04 | 0.28 | 0.09 | — | — | — | — | — | — | 0.003 | 0.073 | — | — |
| 20 | 0.184 | 1.07 | 2.01 | 0.01 | 0.002 | 0.04 | 0.56 | — | 0.12 | 0.10 | — | 0.0027 | — | — | 0.004 | 0.015 | — | — |
| 21 | 0.132 | 0.78 | 2.27 | 0.01 | 0.002 | 0.04 | 0.22 | 0.05 | — | — | — | — | — | — | 0.003 | — | — | 0.126 |
| 22 | 0.145 | 1.86 | 1.67 | 0.01 | 0.002 | 0.03 | — | 0.31 | — | — | 0.0019 | — | — | — | 0.004 | — | 0.015 | — |

TABLE 2-continued

| Steel grade | Chemical components (mass %) (remainder: iron and unavoidable impurities) | | | | | | | | | | | | | | | | | |
|---|---|---|---|---|---|---|---|---|---|---|---|---|---|---|---|---|---|---|
| | C | Si | Mn | P | S | Al | Cr | Mo | Cu | Ni | B | Ca | Mg | REM | N | Ti | Nb | V |
| 23 | 0.086 | 0.53 | 3.32 | 0.02 | 0.001 | 0.06 | — | — | — | — | — | 0.0011 | — | 0.0018 | 0.002 | 0.090 | — | — |
| 24 | 0.091 | 1.54 | 2.87 | 0.01 | 0.001 | 0.04 | 0.24 | — | — | — | — | — | — | — | 0.003 | 0.041 | — | — |
| 25 | 0.112 | 1.98 | 2.15 | 0.01 | 0.001 | 0.04 | 0.82 | — | — | — | — | — | — | — | 0.003 | 0.130 | 0.110 | — |
| 26 | 0.077 | 2.44 | 2.86 | 0.01 | 0.001 | 0.04 | 0.21 | 0.22 | — | — | — | — | — | — | 0.002 | 0.077 | — | — |
| 27 | 0.215 | 1.34 | 2.49 | 0.01 | 0.001 | 0.05 | — | — | — | — | — | — | — | — | 0.002 | — | 0.078 | — |
| 28 | 0.035 | 0.05 | 2.73 | 0.01 | 0.001 | 0.04 | — | — | — | — | — | — | — | — | 0.004 | — | — | — |
| 29 | 0.089 | 3.24 | 1.77 | 0.01 | 0.001 | 0.05 | — | — | — | — | — | — | — | — | 0.004 | — | — | 0.067 |
| 30 | 0.181 | 1.38 | 1.26 | 0.01 | 0.001 | 0.04 | 0.33 | 0.72 | — | — | — | — | — | — | 0.004 | — | — | — |
| 31 | 0.086 | 1.89 | 2.31 | 0.01 | 0.001 | 0.05 | 1.25 | — | 0.08 | 0.05 | 0.0050 | 0.0030 | — | — | 0.004 | — | — | — |

* "—" means additive-free

TABLE 3

| Test No. | Steel grade | Cold reduction ratio (%) | Heating rate (° C./min.) HR1 | HR2 | HR3 | $Ac_1$ (° C.) | $Ac_3$ (° C.) | Trec (° C.) | Expression(4) lower limit (° C.) | Highest achieved temperature (° C.) | Expression(4) upper limit (° C.) | Residence time t (sec.) *1 | Galvanizing category |
|---|---|---|---|---|---|---|---|---|---|---|---|---|---|
| 1-1 | 1 | 30 | 600 | 600 | 60 | 699 | 803 | 921 | 699 | 800 | 803 | 210 | GA |
| 1-2 | 1 | 70 | 600 | 600 | 60 | 699 | 803 | 761 | 699 | 800 | 761 | 210 | GA |
| 2-1 | 2 | 40 | 600 | 600 | 60 | 759 | 887 | 878 | 759 | 850 | 878 | 260 | GA |
| 2-2 | 2 | 50 | 600 | 30 | 60 | 759 | 887 | 838 | 759 | 820 | 838 | 350 | GA |
| 2-3 | 2 | 30 | 600 | 600 | 60 | 759 | 887 | 918 | 759 | 750 | 887 | 210 | GA |
| 3-1 | 3 | 50 | 600 | 600 | 60 | 700 | 802 | 842 | 700 | 800 | 802 | 210 | GA |
| 3-2 | 3 | 70 | 600 | 600 | 60 | 700 | 802 | 762 | 700 | 800 | 762 | 210 | GA |
| 4-1 | 4 | 40 | 600 | 600 | 60 | 768 | 907 | 878 | 768 | 850 | 878 | 260 | GA |
| 4-2 | 4 | 50 | 600 | 600 | 600 | 768 | 907 | 838 | 768 | 780 | 838 | 118 | GA |
| 5-1 | 5 | 30 | 600 | 600 | 60 | 709 | 809 | 915 | 709 | 800 | 809 | 210 | GA |
| 6-1 | 6 | 20 | 600 | 600 | 60 | 747 | 841 | 954 | 747 | 820 | 841 | 210 | GA |
| 6-2 | 6 | 20 | 600 | 600 | 60 | 747 | 841 | 954 | 747 | 820 | 841 | 210 | GI |
| 7-1 | 7 | 40 | 600 | 600 | 60 | 768 | 911 | 879 | 768 | 850 | 879 | 240 | GA |
| 7-2 | 7 | 40 | 600 | 600 | 60 | 768 | 911 | 879 | 768 | 850 | 879 | 240 | GI |
| 8-1 | 8 | 50 | 600 | 600 | 60 | 702 | 804 | 839 | 702 | 800 | 804 | 160 | GA |
| 8-2 | 8 | 50 | 600 | 600 | 60 | 702 | 804 | 839 | 702 | 800 | 804 | 160 | GI |
| 9-1 | 9 | 30 | 600 | 600 | 60 | 719 | 831 | 923 | 719 | 800 | 831 | 160 | GA |
| 10-1 | 10 | 30 | 600 | 600 | 60 | 717 | 816 | 929 | 717 | 800 | 816 | 160 | GA |
| 11-1 | 11 | 50 | 600 | 600 | 60 | 721 | 808 | 831 | 721 | 800 | 808 | 190 | GA |
| 11-2 | 11 | 70 | 600 | 600 | 60 | 721 | 808 | 751 | 721 | 900 | 751 | 310 | GA |
| 11-3 | 11 | 50 | 600 | 600 | 60 | 721 | 808 | 831 | 721 | 800 | 808 | 560 | GA |
| 12-1 | 12 | 20 | 600 | 600 | 60 | 757 | 884 | 965 | 757 | 850 | 884 | 210 | GA |
| 13-1 | 13 | 30 | 600 | 600 | 60 | 734 | 831 | 921 | 734 | 800 | 831 | 210 | GA |
| 14-1 | 14 | 30 | 600 | 600 | 60 | 747 | 846 | 925 | 747 | 820 | 846 | 210 | GA |
| 15-1 | 15 | 30 | 600 | 600 | 60 | 712 | 808 | 939 | 712 | 800 | 808 | 210 | GA |

*1 Residence time in the temperature range from 600° C. to a highest achieved temperature

TABLE 4

| Test No. | Steel grade | Cold reduction ratio (%) | Heating rate (° C./min.) HR1 | HR2 | HR3 | $Ac_1$ (° C.) | $Ac_3$ (° C.) | Trec (° C.) | Expression(4) lower limit (° C.) | Highest achieved temperature (° C.) | Expression(4) upper limit (° C.) | Residence time t (sec.) *1 | Galvanizing category |
|---|---|---|---|---|---|---|---|---|---|---|---|---|---|
| 16-1 | 16 | 50 | 600 | 600 | 60 | 700 | 828 | 967 | 700 | 800 | 828 | 210 | GA |
| 16-2 | 16 | 50 | 600 | 600 | 60 | 700 | 828 | 967 | 700 | 800 | 828 | 160 | GI |
| 16-3 | 16 | 70 | 600 | 600 | 60 | 700 | 828 | 767 | 700 | 800 | 767 | 260 | GI |
| 17-1 | 17 | 20 | 600 | 600 | 60 | 755 | 896 | 1140 | 755 | 850 | 896 | 240 | GA |
| 17-2 | 17 | 30 | 600 | 600 | 60 | 755 | 896 | 1040 | 755 | 850 | 896 | 240 | GA |
| 17-3 | 17 | 50 | 600 | 600 | 60 | 755 | 896 | 840 | 755 | 850 | 840 | 260 | GA |
| 18-1 | 18 | 30 | 600 | 600 | 60 | 707 | 802 | 1209 | 707 | 800 | 802 | 210 | GA |
| 19-1 | 19 | 50 | 600 | 600 | 60 | 704 | 821 | 1004 | 704 | 800 | 821 | 190 | GA |
| 19-2 | 19 | 50 | 600 | 600 | 60 | 704 | 821 | 1004 | 704 | 800 | 821 | 190 | GI |
| 20-1 | 20 | 30 | 600 | 600 | 60 | 740 | 831 | 912 | 740 | 800 | 831 | 210 | GA |
| 20-2 | 20 | 50 | 600 | 600 | 60 | 740 | 831 | 712 | 740 | 820 | 712 | 280 | GA |
| 21-1 | 21 | 50 | 600 | 600 | 60 | 725 | 839 | 1184 | 725 | 820 | 839 | 230 | GA |
| 22-1 | 22 | 40 | 600 | 600 | 60 | 759 | 894 | 828 | 759 | 820 | 828 | 230 | GA |
| 22-2 | 22 | 40 | 600 | 600 | 60 | 759 | 894 | 828 | 759 | 820 | 828 | 230 | GI |
| 23-1 | 23 | 50 | 600 | 600 | 60 | 703 | 846 | 1098 | 703 | 800 | 846 | 190 | GA |
| 24-1 | 24 | 30 | 600 | 600 | 60 | 741 | 870 | 1050 | 741 | 850 | 870 | 240 | GA |
| 25-1 | 24 | 50 | 600 | 600 | 60 | 771 | 934 | 1970 | 771 | 870 | 934 | 260 | GA |

TABLE 4-continued

| Test No. | Steel grade | Cold reduction ratio (%) | Heating rate (° C./min.) HR1 | HR2 | HR3 | $Ac_1$ (° C.) | $Ac_3$ (° C.) | Trec (° C.) | Expression(4) lower limit (° C.) | Highest achieved temperature (° C.) | Expression(4) upper limit (° C.) | Residence time t (sec.) *1 | Galvanizing category |
|---|---|---|---|---|---|---|---|---|---|---|---|---|---|
| 26-1 | 25 | 50 | 600 | 600 | 60 | 767 | 934 | 1037 | 767 | 870 | 934 | 280 | GA |
| 26-2 | 25 | 30 | 600 | 600 | 600 | 767 | 934 | 1237 | 767 | 780 | 934 | 118 | GA |
| 27-1 | 26 | 30 | 600 | 600 | 60 | 735 | 828 | 1322 | 735 | 800 | 828 | 210 | GA |
| 28-1 | 27 | 30 | 600 | 600 | 60 | 695 | 820 | 918 | 695 | 800 | 820 | 210 | GA |
| 29-1 | 28 | 30 | 600 | 600 | 60 | 798 | 975 | 915 | 798 | 850 | 915 | 240 | GA |
| 30-1 | 29 | 30 | 600 | 600 | 60 | 755 | 894 | 916 | 755 | 800 | 894 | 190 | GA |
| 31-1 | 30 | 30 | 600 | 600 | 60 | 774 | 876 | 924 | 774 | 850 | 876 | 260 | GA |

*1 Residence time in the temperature range from 600° C. to a highest achieved temperature Observation of Metallographic Structure With regard to ferrite and martensite structures, an arbitrary region (about 50 μm×50 μm) at a position in the depth of t/4 (t: sheet thickness) on a cross section perpendicular to the rolling direction of a steel sheet obtained as stated above is observed at the magnification of 3,000 with a scanning electron microscope (SEM). Five visual fields are observed and an arithmetic average of the area ratios measured by the point counting method is obtained. Then, with regard to retained austenite, a volume fraction is measured by the saturation magnetization method and the volume fraction is converted into an area ratio ((R & D Kobe Steel Engineering Reports, Vol. 52 No. 3).

Measurement of Tensile Strength

A test piece of JIS Z2201 #5 is sampled from a position in the depth of t/4 (t: sheet thickness) of a steel sheet and a tensile strength (TS), a yield strength (YP), and a total elongation (EL) are measured in accordance with JIS Z2241. A yield ratio (YR) and TS×EL are computed from those values. With regard to TS, 980 MPa or more is accepted and, with regard to YR, 60% or more is accepted. Further, with regard to EL, in accordance with the strength level, EL of 14% or more is accepted when the expression 980 MPa≦TS<1,180 MPa is satisfied, EL of 12% or more is accepted when the expression 1,180 MPa≦TS<1,270 MPa is satisfied, and EL of 11% or more is accepted when the expression 1,270 MPa≦TS<1,370 MPa is satisfied.

Measurement of Grain Boundary Frequency

A length per unit area of the grain boundaries of crystal grains the crystal orientation differences of which are 10 degrees or more and a length per unit area of the grain boundaries of crystal grains the crystal orientation differences of which are less than 10 degrees are computed by applying crystal orientation analysis in the vicinity of a position in the depth of t/4 (t: sheet thickness) on a cross section perpendicular to the width direction of a steel sheet by the SEM-EBSP (Scanning Electron Microscope-Electron BackScattering Pattern) method as stated above. In the EBSP method, three visual fields in the area of 50 μm×50 μm are measured at the steps of 0.1 μm and the crystal orientation analysis is carried out under the condition of CI value ≧0.1.

Measurement of Average Grain Diameter and Grain Size Frequency of Ferrite Grains Surrounded by the Grain Boundaries of Crystal Grains the Crystal Orientation Differences of which are 10 Degrees or More The average grain diameter of ferrite grains surrounded by the grain boundaries of crystal grains the crystal orientation differences of which are 10 degrees or more is obtained in the vicinity of a position in the depth of t/4 (t: sheet thickness) on a cross section perpendicular to the width direction of a steel sheet by a quadrature method (measurement region: 200 μm×200 μm). Then with regard to a grain size distribution too, in the same visual fields, the proportion of the area of the ferrite grains 30 μm or less in grain diameter to the area of the ferrite grains surrounded by the grain boundaries of crystal grains the crystal orientation differences of which are 10 degrees or more is obtained. The measurement is carried out in five visual fields and arithmetic averages of the grain diameters and the grain size frequencies are obtained.

Figure 2:
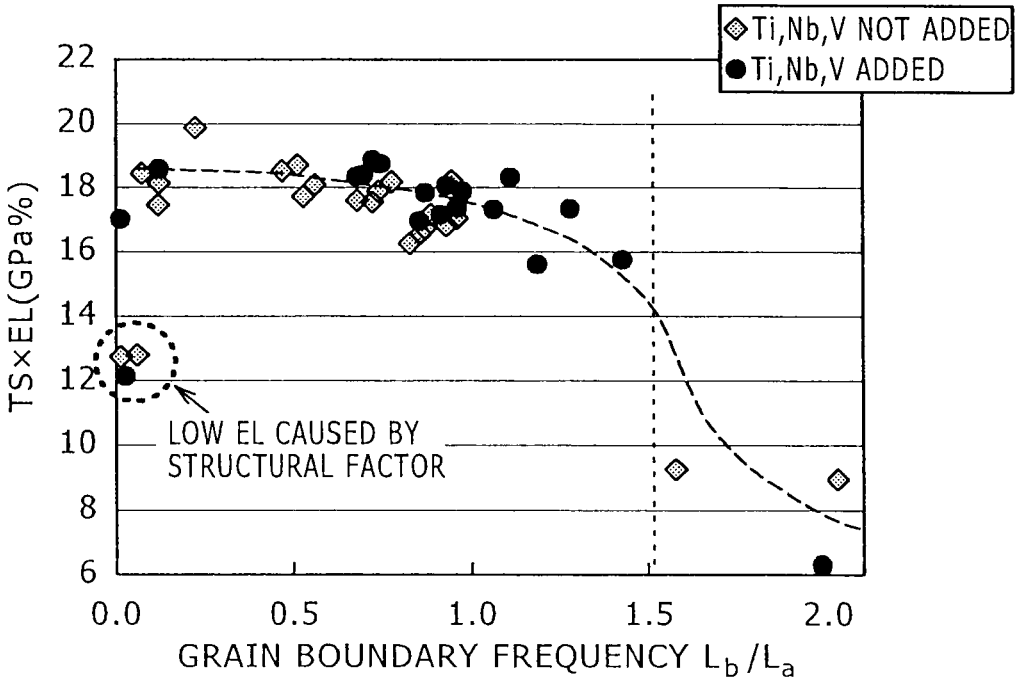
FIG. 2 is a graph showing the relationship between a grain boundary frequency ($L_b/L_a$) and a value of TS×EL.
Figure 3:
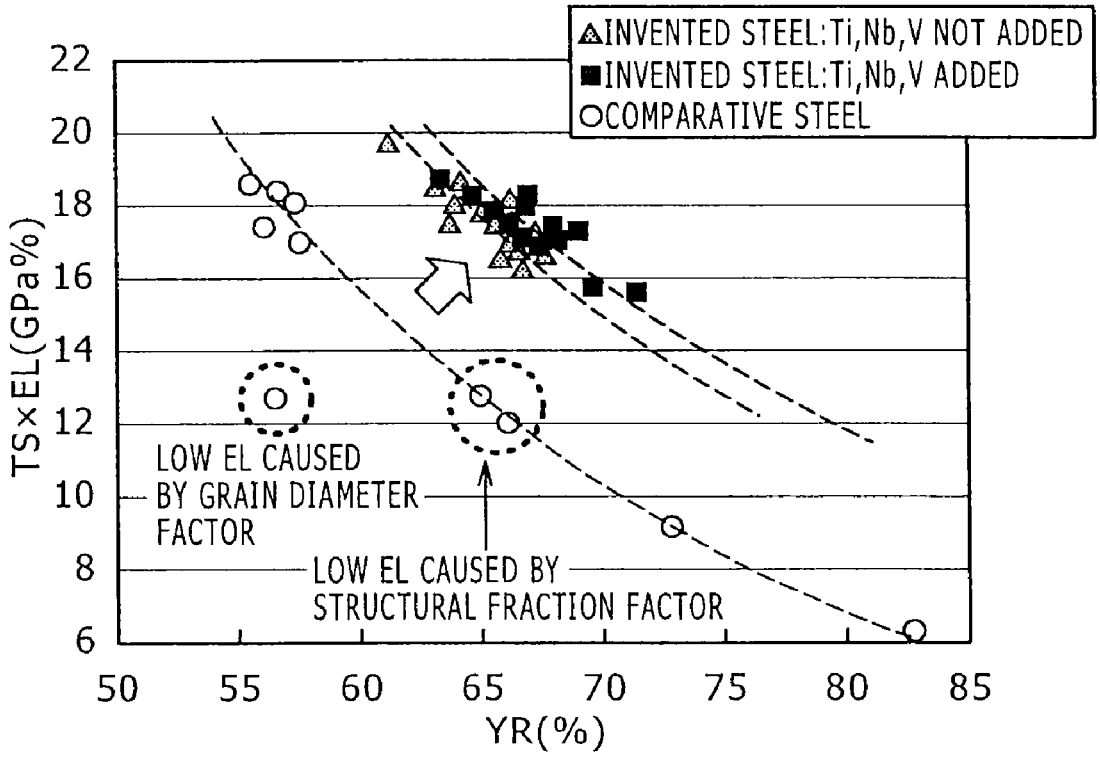
FIG. 3 is a graph showing the relationship between a yield ratio (YR) and a value of TS×EL.

The results are shown in FIGS. 1 to 3 and Tables 5 and 6.

TABLE 5

| Test No. | Microstructure: Grain boundary frequency ($L_b/L_a$) | Average ferrite grain diameter (μm) *1 | Judgment of grain size frequency acceptance | (1) Ferrite fraction (area %) | (2) Martensite fraction (area %) | (3) Retained austenite fraction (area %) | (1) + (2) + (3) (area %) | Mechanical properties: YP (MPa) | TS (MPa) | YR (%) | EL (%) | TS × EL (GPa %) |
|---|---|---|---|---|---|---|---|---|---|---|---|---|
| 1-1 | 0.68 | 8 | ○ | 46 | 35 | 0 | 81 | 655 | 996 | 66 | 18 | 18 |
| 1-2 | 0.08 | 15 | ○ | 54 | 26 | 0 | 80 | 540 | 949 | 57 | 19 | 18 |
| 2-1 | 0.78 | 12 | ○ | 56 | 32 | 6 | 94 | 655 | 988 | 66 | 18 | 18 |
| 2-2 | 0.12 | 18 | ○ | 48 | 26 | 0 | 74 | 496 | 861 | 58 | 21 | 18 |
| 2-3 | 2.03 | 5 | ○ | 100 | 0 | 0 | 100 | 1007 | 1044 | 96 | 9 | 9 |
| 3-1 | 0.23 | 10 | ○ | 47 | 33 | 0 | 80 | 635 | 1035 | 61 | 19 | 20 |
| 3-2 | 0.06 | 16 | ○ | 51 | 15 | 0 | 66 | 622 | 957 | 65 | 13 | 13 |
| 4-1 | 0.74 | 10 | ○ | 43 | 37 | 7 | 87 | 648 | 994 | 65 | 18 | 18 |
| 4-2 | 1.58 | 4 | ○ | 57 | 32 | 6 | 95 | 801 | 1098 | 73 | 8 | 9 |
| 5-1 | 0.53 | 14 | ○ | 45 | 33 | 0 | 78 | 700 | 1063 | 66 | 17 | 18 |
| 6-1 | 0.95 | 12 | ○ | 44 | 42 | 4 | 90 | 679 | 1021 | 66 | 18 | 18 |
| 6-2 | 0.89 | 12 | ○ | 44 | 29 | 5 | 78 | 664 | 993 | 67 | 17 | 17 |
| 7-1 | 0.87 | 8 | ○ | 47 | 41 | 4 | 92 | 685 | 1012 | 68 | 17 | 17 |
| 7-2 | 0.83 | 8 | ○ | 47 | 28 | 8 | 83 | 659 | 986 | 67 | 17 | 16 |

TABLE 5-continued

| Test No. | Microstructure: Grain boundary frequency ($L_b/L_a$) | Average ferrite grain diameter (μm) *1 | Judgment of grain size frequency acceptance | (1) Ferrite fraction (area %) | (2) Martensite fraction (area %) | (3) Retained austenite fraction (area %) | (1) + (2) + (3) (area %) | Mechanical properties: YP (MPa) | TS (MPa) | YR (%) | EL (%) | TS × EL (GPa %) |
|---|---|---|---|---|---|---|---|---|---|---|---|---|
| 8-1 | 0.51 | 10 | ○ | 36 | 42 | 0 | 78 | 673 | 1046 | 64 | 18 | 19 |
| 8-2 | 0.72 | 10 | ○ | 36 | 38 | 0 | 74 | 657 | 1029 | 64 | 17 | 18 |
| 9-1 | 0.86 | 10 | ○ | 47 | 30 | 1 | 78 | 666 | 1011 | 66 | 16 | 17 |
| 10-1 | 0.89 | 12 | ○ | 38 | 41 | 2 | 81 | 812 | 1224 | 66 | 14 | 17 |
| 11-1 | 0.47 | 14 | ○ | 41 | 36 | 3 | 80 | 755 | 1192 | 63 | 16 | 19 |
| 11-2 | 0.02 | 32 | X | 58 | 35 | 2 | 95 | 567 | 998 | 57 | 13 | 13 |
| 11-3 | 0.12 | 17 | ○ | 43 | 39 | 4 | 86 | 613 | 1087 | 56 | 16 | 17 |
| 12-1 | 0.95 | 10 | ○ | 37 | 56 | 2 | 95 | 816 | 1211 | 67 | 14 | 17 |
| 13-1 | 0.96 | 10 | ○ | 33 | 49 | 3 | 85 | 798 | 1204 | 66 | 14 | 17 |
| 14-1 | 0.93 | 12 | ○ | 24 | 66 | 2 | 92 | 849 | 1275 | 67 | 13 | 17 |
| 15-1 | 0.56 | 10 | ○ | 9 | 78 | 2 | 89 | 843 | 1316 | 64 | 14 | 18 |

*1 Average of D when the circle equivalent diameter of each of ferrite grains surrounded by the grain boundaries of crystal grains the crystal orientation differences of which are 10 degrees or more is defined as D

TABLE 6

| Test No. | Microstructure: Grain boundary frequency ($L_b/L_a$) | Average ferrite grain diameter (μm) *1 | Judgment of grain size frequency acceptance | (1) Ferrite fraction (area %) | (2) Martensite fraction (area %) | (3) Retained austenite fraction (area %) | (1) + (2) + (3) (area %) | Mechanical properties: YP (MPa) | TS (MPa) | YR (%) | EL (%) | TS × EL (GPa %) |
|---|---|---|---|---|---|---|---|---|---|---|---|---|
| 16-1 | 0.69 | 4 | ○ | 45 | 49 | 0 | 94 | 692 | 1067 | 65 | 17 | 18 |
| 16-2 | 0.95 | 4 | ○ | 45 | 31 | 0 | 76 | 700 | 1025 | 68 | 17 | 17 |
| 16-3 | 0.03 | 10 | ○ | 43 | 24 | 0 | 67 | 652 | 984 | 66 | 12 | 12 |
| 17-1 | 1.11 | 6 | ○ | 48 | 43 | 5 | 96 | 683 | 1020 | 67 | 18 | 18 |
| 17-2 | 1.07 | 7 | ○ | 46 | 40 | 6 | 92 | 666 | 1007 | 66 | 17 | 17 |
| 17-3 | 0.12 | 12 | ○ | 59 | 32 | 4 | 95 | 507 | 910 | 56 | 20 | 19 |
| 18-1 | 0.72 | 8 | ○ | 46 | 39 | 0 | 85 | 667 | 1054 | 63 | 18 | 19 |
| 19-1 | 1.28 | 5 | ○ | 44 | 42 | 0 | 86 | 708 | 1025 | 69 | 17 | 17 |
| 19-2 | 1.19 | 5 | ○ | 44 | 34 | 0 | 78 | 723 | 1012 | 71 | 15 | 16 |
| 20-1 | 0.93 | 6 | ○ | 45 | 43 | 4 | 92 | 699 | 1044 | 67 | 17 | 18 |
| 20-2 | 0.02 | 15 | ○ | 37 | 56 | 0 | 93 | 607 | 1050 | 58 | 16 | 17 |
| 21-1 | 0.98 | 6 | ○ | 48 | 28 | 3 | 79 | 651 | 990 | 66 | 18 | 18 |
| 22-1 | 0.74 | 6 | ○ | 44 | 41 | 5 | 90 | 645 | 1017 | 63 | 18 | 19 |
| 22-2 | 0.68 | 6 | ○ | 44 | 36 | 5 | 85 | 643 | 994 | 65 | 18 | 18 |
| 23-1 | 0.98 | 2 | ○ | 36 | 54 | 1 | 91 | 828 | 1216 | 68 | 14 | 17 |
| 24-1 | 0.92 | 3 | ○ | 35 | 52 | 4 | 91 | 808 | 1213 | 67 | 14 | 17 |
| 25-1 | 1.43 | 4 | ○ | 33 | 47 | 2 | 82 | 835 | 1199 | 70 | 13 | 16 |
| 26-1 | 0.87 | 4 | ○ | 25 | 68 | 4 | 97 | 847 | 1284 | 66 | 14 | 18 |
| 26-2 | 1.98 | 3 | ○ | 58 | 39 | 2 | 99 | 752 | 909 | 83 | 7 | 6 |
| 27-1 | 0.86 | 4 | ○ | 18 | 75 | 3 | 96 | 889 | 1318 | 67 | 13 | 17 |
| 28-1 | 0.62 | 24 | ○ | 83 | 14 | 0 | 97 | 473 | 547 | 86 | 23 | 13 |
| 29-1 | 0.78 | 6 | ○ | 78 | 8 | 4 | 90 | 447 | 564 | 79 | 27 | 15 |
| 30-1 | 0.83 | 14 | ○ | 42 | 7 | 0 | 49 | 481 | 583 | 83 | 23 | 14 |
| 31-1 | 0.65 | 12 | ○ | 46 | 49 | 5 | 100 | 660 | 1092 | 60 | 12 | 13 |

*1 Average of D when the circle equivalent diameter of each of ferrite grains surrounded by the grain boundaries of crystal grains the crystal orientation differences of which are 10 degrees or more is defined as D In the cases where the steel grades 28 to 31 having chemical compositions deviating from the ranges stipulated in the present invention are used, the tensile strength or the elongation is poor as a result. More specifically, No. 28-1 is the case where the C amount is small and the strength is low. No. 29-1 is the case where the Si amount is large, the $Ac_1$ point is high, thereby the ferrite fraction is high, and a sufficiently good strength is not obtained although the elongation is good. No. 30-1 is the case where the Mn amount is small, the hardenability is secured insufficiently, hence the martensite fraction is low, and the strength is low. No. 31-1 is the case where the Cr amount is large and the elongation is low although the strength is good.

Then Nos. 1-2, 3-2, 11-2, 16-3, 17-3, and 20-2 are the cases where $T_{rec}$ is low because of the balance between a cold reduction ratio and components in a steel. As a result, a highest achieved temperature exceeds $T_{rec}$, and a grain boundary frequency, an average ferrite grain diameter, or a grain size frequency deviates from the ranges stipulated in the present invention, and a strength, a yield ratio, or an elongation is low.

No. 2-2 is the case where HR2 is low, the grain boundary frequency is low, and hence the yield ratio is low.

No. 2-3 is the case where the highest achieved temperature is lower than the $Ac_1$ point, hence the reverse transformation to austenite does not occur, and a DP structure is not obtained.

No. 11-3 is the case where the residence time in the temperature range from 600° C. to the highest achieved temperature is long, the processed structure recovers remarkably, and thus the grain boundary frequency lowers and the yield ratio is low.

Nos. 4-2 and 26-2 are the cases where HR3 is high, hence recovery scarcely occurs, the boundaries of crystal grains the crystal orientation differences of which are less than 10 degrees remain abundantly, and the elongation deteriorates.

With regard to the steel sheets used in the present examples, the relationship between a grain boundary frequency and a yield ratio is shown in FIG. 1, the relationship between a grain boundary frequency and a value of TS×EL is shown in FIG. 2, and the relationship between a yield ratio and a value of TS×EL is shown in FIG. 3.

From FIG. 1, it is understood that the yield ratio increases as the grain boundary frequency ($L_b/L_a$) increases. Further from FIG. 2, it is understood that the elongation (EL) lowers when the grain boundary frequency ($L_b/L_a$) exceeds a certain level. Moreover as it is obvious from FIG. 3, the steel sheets according to the present invention show higher TS×EL values than the comparative steel sheets even though the values of YR are the same and, among the steel sheets according to the present invention, a steel sheet containing at least one of Ti, Nb, and V has better balance between a value of YR and a value of TS×EL than a steel sheet containing none of Ti, Nb, or V. This is presumably because, by the addition of Ti, Nb, or V, $T_{rec}$ rises and the grain boundary frequency ($L_b/L_a$) increases.

A steel sheet according to the present invention is a high-strength hot-dip galvanized steel sheet showing a high yield ratio and having a high elongation and the possible applications thereof are collision parts such as side members at the front and the rear and a crash box, car body components such as pillars including a center pillar RF, a roof rail RF, a side sill, a floor member, and a kick section, impact resistant parts such as a bumper RF and a door impact beam, and others of an automobile.

What is claimed is:

1. A hot-dip galvanized steel sheet containing

C: 0.05 to 0.3% (in terms of mass %, hereunder same as above with respect to chemical composition), Si: 0.005 to 3.0%, Mn: 1.5 to 3.5%, Al: 0.005 to 0.15%, P: 0.1% or less, and S: 0.05% or less, with the remainder comprising of iron and unavoidable impurities, wherein:

in percentage in a metallographic structure, the area ratio of ferrite is 5 to 85%, the area ratio of martensite is 15 to 90%, the area ratio of retained austenite is 20% or less, and the sum of the area ratios of said ferrite, said martensite, and said retained austenite is 70% or more;

in the ferrite structure, when the length per unit area of the grain boundaries of crystal grains the crystal orientation differences of which are 10 degrees or more is defined as $L_a$ and the length per unit area of the grain boundaries of crystal grains the crystal orientation differences of which are less than 10 degrees is defined as $L_b$, the expression $0.2 \leqq (L_b/L_a) \leqq 1.5$ is satisfied;

when the circle equivalent diameter of each of ferrite grains surrounded by the grain boundaries of crystal grains the crystal orientation differences of which are 10 degrees or more is defined as D, the average value of D is 25 μm or less, and the area ratio of crystal grains satisfying the expression $D \leqq 30$ μm in the ferrite grains surrounded by the grain boundaries of crystal grains the crystal orientation differences of which are 10 degrees or more is 50% or more; and the tensile strength of said hot-dip galvanized steel sheet is 980 MPa or more.

2. A high-strength hot-dip galvanized steel sheet according to claim 1, further containing Cr: 1.0% or less.

3. A high-strength hot-dip galvanized steel sheet according to claim 1, further containing Mo: 1.0% or less.

4. A high-strength hot-dip galvanized steel sheet according to claim 1, further containing at least one selected from among the group of Ti: 0.2% or less, Nb: 0.3% or less, and V: 0.2% or less.

5. A high-strength hot-dip galvanized steel sheet according to claim 1, further containing at least either one of Cu: 3% or less, and Ni: 3% or less.

6. A high-strength hot-dip galvanized steel sheet according to claim 1, further containing B: 0.01% or less.

7. A high-strength hot-dip galvanized steel sheet according to claim 1, further containing at least one selected from among the group of Ca: 0.01% or less, Mg: 0.01% or less, and REM: 0.005% or less.

8. A high-strength hot-dip galvanized steel sheet according to claim 1, wherein alloying hot-dip galvanizing is applied as the hot-dip galvanizing.

9. A method for producing a high-strength hot-dip galvanized steel sheet according to claim 1, said method comprising:

heating a cold-rolled steel sheet so that the heating rate may satisfy the expressions (1) to (3) below and the highest achieved temperature during the heating may satisfy the expression (4) below; and applying annealing so that the residence time in the temperature range from 600° C. to said highest achieved temperature may be 400 seconds or less, heating rate from room temperature to 350° C.: HR1≦900° C./min. (1), heating rate from 350° C. to 700° C.: HR2≧60° C./min. (2), 5° C./min.≦heating rate from 700° C. to highest achieved temperature: HR3≦420° C./min. (3), $Ac_1$ point≦(highest achieved temperature)≦(lower temperature of either $T_{rec}$ or $Ac_3$ point) (4), where $T_{rec}$ is defined as $$T_{rec}=-4\times(\text{cold reduction ratio})+1{,}000+3\times(\text{Si }\%)+14\times(\text{Mn }\%)+2\times(\text{Cr }\%)+19\times(\text{Mo }\%)+38\times(\text{Cu }\%)+2\times(\text{Ni }\%),$$

when none of Ti, Nb, and V is contained, and $$T_{rec}=-10\times(\text{cold reduction ratio})+1{,}100+3\times(\text{Si }\%)+14\times(\text{Mn }\%)+2\times(\text{Cr }\%)+19\times(\text{Mo }\%)+38\times(\text{Cu }\%)+2\times(\text{Ni }\%)+5{,}000\times(\text{Ti }\%)+6{,}200\times(\text{Nb }\%)+4{,}350\times(\text{V }\%),$$

when at least one of Ti, Nb, and V is contained, (each (element name %) represents the content (mass %) of each element).

10. A high-strength hot-dip galvanized steel sheet according to claim 1, wherein the expression $0.25 \leqq (L_b/L_a) \leqq 1.4$ is satisfied.

11. A high-strength hot-dip galvanized steel sheet according to claim 1, wherein the expression $0.30 \leqq (L_b/L_a) \leqq 1.3$ is satisfied.

12. A high-strength hot-dip galvanized steel sheet according to claim 1, wherein the average value of D is 20 μM or less.

13. A high-strength hot-dip galvanized steel sheet according to claim 1, wherein the average value of D is 15 μm or less.

14. A high-strength hot-dip galvanized steel sheet according to claim 1, wherein the area ratio of crystal grains satisfying the expression D≦30 μm in the ferrite grains surrounded by the grain boundaries of crystal grains the crystal orientation differences of which are 10 degrees or more is 60% or more.

15. A high-strength hot-dip galvanized steel sheet according to claim 1, wherein the area ratio of crystal grains satisfying the expression D≦30 μm in the ferrite grains surrounded by the grain boundaries of crystal grains the crystal orientation differences of which are 10 degrees or more is 70% or more.

16. A high-strength hot-dip galvanized steel sheet according to claim 1, wherein the sum of the area ratios of said ferrite, said martensite, and said retained austenite is 75% or more.

17. A high-strength hot-dip galvanized steel sheet according to claim 1, wherein the hot-dip galvanized steel sheet has a yield ratio of 60% or more.

18. A high-strength hot-dip galvanized steel sheet according to claim 1, wherein when total elongation is 14% or more, the expression 980 MPa≦TS<1,180 MPa is satisfied, wherein TS means tensile strength.

19. A high-strength hot-dip galvanized steel sheet according to claim 1, wherein when total elongation is 12% or more, the expression 1,180 MPa≦TS<1,270 MPa is satisfied, wherein TS means tensile strength.

20. A high-strength hot-dip galvanized steel sheet according to claim 1, wherein when total elongation is 11% or more, the expression 1,270 MPa≦TS<1,370 MPa is satisfied, wherein TS means tensile strength.

* * * * *